United States Patent [19]

Endres

[11] 4,224,000

[45] Sep. 23, 1980

[54] TUBULAR DRAFTING PEN WITH IMPROVED WRITING POINT ASSEMBLY

[75] Inventor: Bernhard Endres, Winkelhaid, Fed. Rep. of Germany

[73] Assignee: J. S. Staedtler, Nuremberg, Fed. Rep. of Germany

[21] Appl. No.: 969,924

[22] Filed: Dec. 15, 1978

[30] Foreign Application Priority Data

Dec. 23, 1977 [DE] Fed. Rep. of Germany ..... 2757554

[51] Int. Cl.[3] ..... A43K 5/00

[52] U.S. Cl. ..... 401/198; 401/223

[58] Field of Search ..... 401/223, 196, 198, 224

[56] References Cited

U.S. PATENT DOCUMENTS

| | | | |
|---|---|---|---|
| 2,949,887 | 8/1960 | Martin et al. | 401/223 X |
| 3,077,185 | 2/1963 | Hansen | 401/223 X |
| 3,126,874 | 3/1964 | Exner | 401/223 X |
| 3,819,284 | 6/1974 | Kreuzer | 401/198 X |

*Primary Examiner*—John D. Yasko

*Attorney, Agent, or Firm*—Toren, McGeady and Stanger

[57] ABSTRACT

A writing point assembly for a tubular drafting pen includes an elongated tubular shell from one end of which a tubular, capillary nib projects. A sliding weight guided in the shell axially bounds an ink storage space in the other end of the shell which is radially imperforate. Ink may flow from the storage space to the nib through an ink feeding channel between the weight and an inner shell wall. Threads on a first section of the outer, axial shell face permit the shell to be fastened in a tubular holder. A collar on the outer axial shell face is spaced intermediate the first face section and the nib center the shell in the holder. The collar defines a portion of an air channel axially by-passing the collar and communicating with the ambient atmosphere. A second axial portion of the outer face intermediate the threads and the other end of the shell defines a further portion of an air channel which communicates with the ink storage space.

10 Claims, 3 Drawing Figures

TUBULAR DRAFTING PEN WITH IMPROVED WRITING POINT ASSEMBLY

This invention relates to fountain pens, and particularly to an improved tubular pen of a type widely used for engineering drafting work.

As is known, for example, from German Utility Model No. 74 16 048 and German Pat. No. 15 11 383, such pens may consist mainly of a tubular holder and a writing point assembly including a capillary, tubular nib which axially projects from the holder in the operative condition of the pen. The writing point assembly is releasably fastened in the holder and defines a channel for flow of writing fluid (hereinafter referred to as "ink" for the sake of brevity) from a reservoir in the holder to the nib, and a channel for air entering the reservoir from the ambient atmosphere.

While the writing point assemblies of the known pens have been used successfully with types of ink for which they are designed, specifically India ink, they operate less satisfactorily with less viscous writing fluids, such as water-based inks, and they are relatively costly to produce because of the need for radial apertures in their tubular shells.

It is an important object of this invention to provide a drafting pen with a writing point assembly less sensitive to the viscosity and other characteristics of the writing fluid employed than known assemblies.

Another object is the provision of a pen whose writing point assembly can be produced at lower cost than was possible heretofore without loss of product quality.

With these and other objects in view, the writing point assembly in a tubular drafting pen of the invention has an elongated tubular shell. A tubular, capillary nib projects longitudinally or axially from one axially terminal portion of the shell, the other axially terminal portion being cup-shaped. The axial shell wall is imperforate. A sliding weight guided in the shell axially bounds an ink storage space in the other axially terminal shell portion. The weight and an inner axial wall of the shell bound an ink feeding channel which connects the ink storage space with the nib. A fastening device is provided on a first section of the outer axial face of the shell for fastening the shell in a tubular holder. A collar on the outer axial face spacedly intermediate the first section and the nib centers the shell by engagement with the holder. The collar defines a portion of an air channel which axially by-passes the collar and communicates with the ambient atmosphere. A second axial portion of the outer shell face intermediate the fastening device and the other axially terminal shell portion defines a further portion of the aforementioned air channel which communicates with the ink storage space.

The invention also resides in a drafting pen in which the afore-described writing point assembly is secured in a holder by the fastening device referred to above.

Other features, additional objects, and many of the attendant advantages of this invention will readily be appreciated as the same becomes better understood by reference to the following detailed description of a preferred embodiment when considered in connection with the appended drawing showing the front portion of a drafting pen according to the invention partly in elevational section through the holder only, and partly in section through the holder and the writing point assembly.

Figure 1:
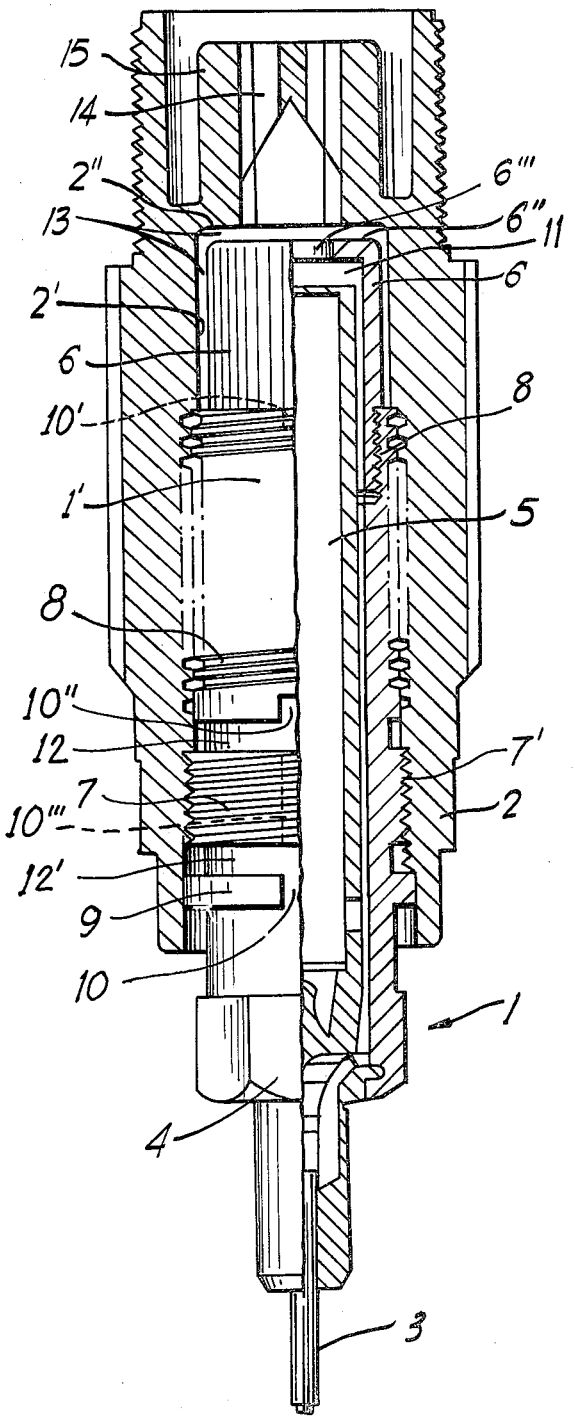
FIG. 1 is an axially extending view partly in section of a portion of a tubular drafting pen embodying the present invention.

The drawing of FIG. 1 shows only as much of a drafting pen as is needed for an understanding of the invention, that is, the front part 2 of a two-part, tubular holder, and the writing point assembly 1 releasably secured in the holder. The portion of the writing point assembly 1 visible outside the holder part 2 includes a capillary, tubular nib 3 axially projecting from the shell 4 of the writing point assembly. The exposed part of the shell 4 is partly hexagonal for engagement by a small mounting wrench, as is conventional.

The inner, axially terminal portion of the shell 4 is constituted by a cup-shaped retainer 6 threadedly fastened in the bore of the cylindrical main portion of the shell. The outer axial face 6′ of the retainer is formed with axial corrugations. The transverse end wall 6″ of the retainer 6 has a central aperture 6‴ and limits sliding, axial movement of a weight 5 in the bore of the shell 4. The end wall 6″ and the radial top face of the weight 5 axially bound therebetween an ink storage space 11 whose capacity varies with the sliding movement of the weight 5, as is known in itself. A capillary annular duct between the weight 5 and the shell 4, 6 provides most of an ink feeding channel from the storage space 11 to the nib 3.

The shell 4 is fastened coaxially in the bore of the holder part 2 by means of engaged threads 7′ on a small axial portion 7 of the outer shell face and on the inner axial wall of the holder 2. The threads on the holder wall extend over an axial distance almost equal to the entire axial length of the shell 4.

An integral collar 9 on the shell 4 spaced intermediate the nib 3 and the threads 7′ engages a smoothly cylindrical inner face portion of the holder 2 to center the shell 4 in the bore of the holder.

A second axial section of the outer shell face carries a helical rib 8 whose pitch is equal to the pitch of the threads 7′, but whose crest defines a cylinder of a diameter only about equal to the root diameter of the threads 7′.

An air channel, wider than the ink feeding channel over most of its length, leads from the atmosphere into the ink reservoir in the non-illustrated portion of the pen holder and begins with a notch 10 in the collar 9 which leads into an annular groove 12′ in the shell 4 separating the collar 9 from the threads 7′. An axial groove 10‴ in the threads 7′ by-passing the seal formed by the engaged threads terminates in another annular groove 12 between the threads 7′ and the shell face portion carrying the rib 8. The flow section of the relatively wide groove between the several turns of the rib is further increased by the grooves between the threads in the inner wall of the holder portion 2. A short, axial groove 10″ connects the annular groove 12 to the lower end of the helical groove between the turns of the rib 8, and a similar axial groove 10′ connects the upper end of the helical groove to a channel 13 radially separating the corrugated face 6′ of the retainer 6 from the axially coextensive inner face portion 2′ of the holder 2 by a distance of capillary dimensions, and further separating the end wall 6″ of the retainer 6 from the radial, annular face 2″ of a shoulder in the holder 2.

The illustrated portion of the holder 2 terminates in a plug 15 formed with axial bores 14 which connect the illustrated structure with the non-illustrated rear portion of the holder for flow of writing fluid from the reservoir in the rear holder portion toward the nib 3, and entry of air into the reservoir from the aforedescribed air channel when the illustrated holder portion is threadedly fastened in the non-illustrated portion.

The portion of the air channel communicating with the ink storage space 11 receives and holds excess ink displaced from the non-illustrated reservoir when the gas pressure in the reservoir exceeds ambient atmospheric pressure as is known in itself. The terms "ink channel" and "air channel", as employed in this application, thus do not imply that such channels are utilized exclusively for the flow of ink or other writing fluid and for flow of air respectively.

While a threaded connection between the shell 4 and the holder 2 has been illustrated and described, the threads 7′ may be replaced by cooperating engagement faces of smoothly circular cross section on the shell 4 and holder 2, and a press fit between slightly conical surfaces is equivalent to the illustrated threads in many respects.

The necessary flow paths for writing fluid and air are provided in the drafting pen of the invention without any need for radial bores in the writing point assembly, more specifically the shell 4, 6, thereby greatly facilitating the manufacture of the writing point assembly. The latter is interchangeable with analogous assemblies in drafting pens now in wide practical use, and may thus replace the existing assemblies without requiring modified holders. The pen of the invention has been found to operate about equally well with India ink, water-based inks, and other writing fluids varying greatly in viscosity.

For the convenience of pictorial representation, all elements of the illustrated drafting pen have been hatched as metal, and the pen actually may be made of metal, and such a metal pen will be fully operative. However, other materials of construction may be employed, and an otherwise identical pen consisting almost entirely of plastic in a manner conventional in itself is specifically contemplated.

It should be understood, therefore, that the foregoing disclosure relates only to a preferred embodiment of the invention, and that it is intended to cover all changes and modifications of the example herein chosen for the purpose of the disclosure which do not constitute departures from the spirit and scope of the invention set forth in the appended claims.

Figure 2:
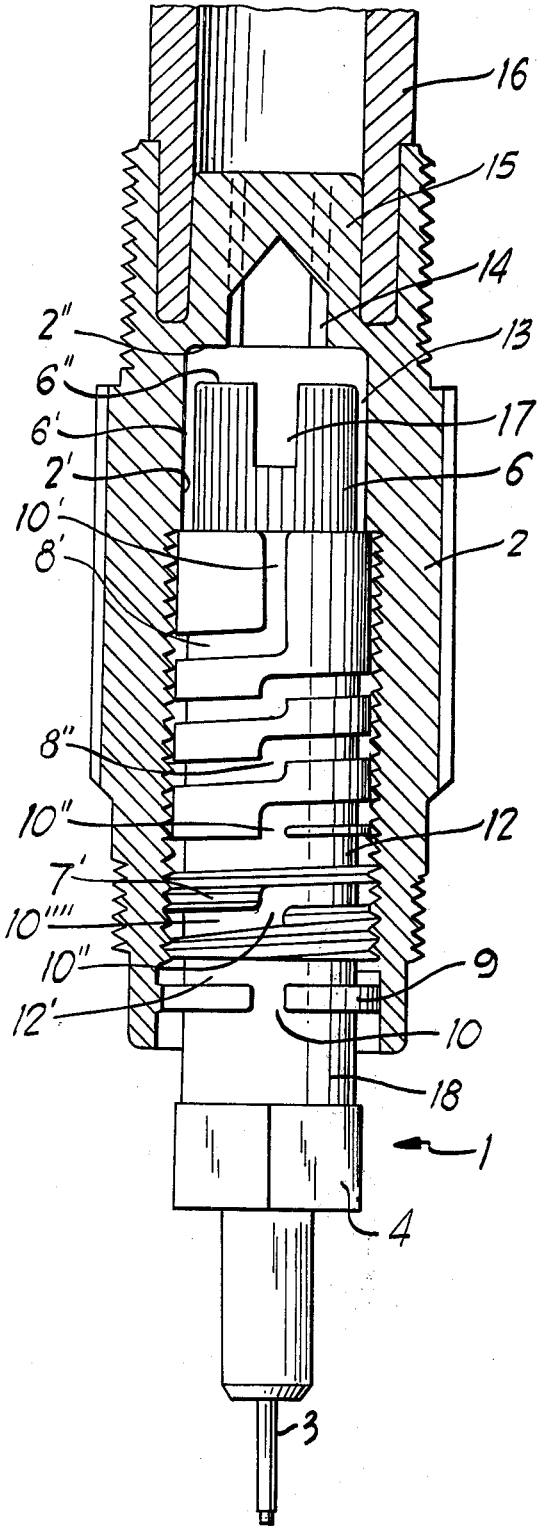
FIG. 2 is another axially extending view partly in section of the portion of the tubular drafting pen illustrated in FIG. 1.

In FIG. 2 an alternative model of the invention is shown. The writing point assembly 1 is connected with the holder part 2 by the fastening thread 7′, as shown in FIG. 1. It includes a tubular nib 3, a cup-shaped retainer 6 and a sliding weight, which is not shown. In the front part of the sliding weight a wire penetrating the tubular nib is fastened. The writing point assembly defines on its shell 4 in identical succession according to the invention, as shown in FIG. 1, the following: an exposed part for engagement by a small mounting wrench, a free annular groove 18 for a better air convention, a collar 9, a non-capilar annular groove 12′, a relatively small axial fastening section e.g. a fastening thread 7′, a further non-capilar annular groove 12 with a bounding substantial portion of the air channel and a further portion of said air channel as interspace 13.

The ink channel with the plug 15, where the ink reservoir 16 is fastened, corresponds to FIG. 1 as well.

However, the difference particularly are the features of the air channel 8′. Already within the fastening thread 7′ at the shell 4 of the writing point assembly 1 extends the air channel from the non-capilar annular groove 12′ as a short axial groove by a helical rib rotating the said shell and following this helical rib of the fastening thread by 180 degrees axially by-passing the bounding helical rib further rotating by 180 degrees and with a similar axial groove it ends in other similar axial grooves 12. From this similar axial groove the air channel 8′ continues its steps each time as described above along the whole further substantial portion of the air channel. The short axial groove 10″ further corresponds to the axial grooves 8″ connecting the channel parts 8′, that are each time rotating by 180 degrees. On the other cup-shaped axially terminal portion of the shell radial slots 17 are shown by which ink and air communicate with the ink storage space.

Figure 3:
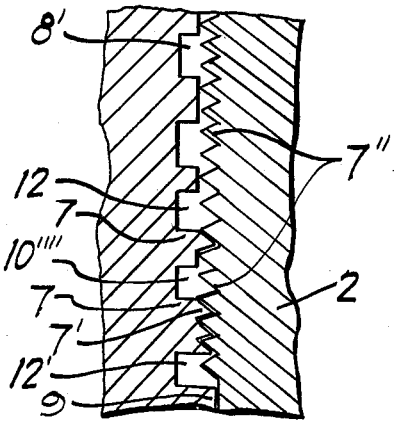
FIG. 3 is a sectional view of an axially extending part of the tubular drafting pen shown in FIGS. 1 and 2.

FIG. 3 shows an enlarged section of the air channel. The fastening internal thread 7″ of the holder is opposite the fastening thread 7′ of the writing point assembly. The collar 9 as well as the fastening thread 7′ of the shell bound a non-capilar groove 12′. A helical groove 10″″ is included in the fastening means. The other non-capilar annular groove 12 bounds the fastening means and the air channel 8′ extends as described above continually and looked upon in cross-section it shows an axial size enclosing one to two ribs of the fastening thread 7″. The major diameter of the shell 4 on the substantial portion of the air channel (axially between the fastening means and other cup-shaped axially terminal portion of the shell) essentially corresponds to the minor diameter of the fastening internal thread 7″ of the holder 2.

These features of the air channel shown in FIGS. 2 and 3 cause an especially exact filling of the channel in case of excess pressure and a complete draining during the pressure drop. Herewith an especially reliable compensation system has been created.

What is claimed is:

1. Writing point assembly for a tubular drafting pen comprising:

(a) an elongated tubular shell having a longitudinal axis;

(b) a tubular, capillary nib projecting in the axial direction of said shell from one terminal portion of said shell in the axial direction thereof, the other terminal portion of said shell being cup-shaped;

(c) a sliding weight guided in said shell and bounding an ink storage space in the axial direction in said other terminal portion, (1) said weight and an inner wall of said shell bounding a section of an ink feeding channel connecting said ink storage space with said nib;

(d) a tubular holder laterally enclosing at least an axially extending part of said shell;

(e) fastening means on a first section of the outer axial face of said shell for fastening the shell in said tubular holder;

(f) a collar on said outer axially extending face of said shell spaced intermediate said fastening means and said nib for centering said shell by engagement with said holder, (1) said collar defining a portion of an air channel axially by-passing said collar and said air channel communicating with the ambient atmosphere, (g) a second axially extending section of said outer face intermediate said fastening means and said other terminal portion defining a further substantial portion of said air channel, said further portion communicating with said ink storage space over the cap-shaped other terminal portion of said shell; and (h) two non-capillary annular grooves one located between said collar and said fastening means and the other located between said fastening means and said further substantial portion of said air channel.

2. An assembly as set forth in claim 1, wherein said other terminal portion has an outer face defining an axially extending passage and includes an apertured transverse wall bounding the bore of said shell, said further portion of said air channel communicating with said ink storage space through said passage and the aperture in said transverse wall.

3. An assembly as set forth in claim 1, said outer axial face being formed with two annular recesses, said recesses respectively separating said fastening means from said collar and said second axial section.

4. An assembly as set forth in claim 1, wherein said second axially extending section of said outer face includes a helical rib about said axis, said fastening means include threads on said first section, the pitch of said rib and of said threads being the same, the crest of said rib defining a cylindrical surface having a diameter substantially equal to the root diameter of said threads.

5. An assembly as set forth in claim 1, wherein said shell is free from radial perforations.

6. A tubular drafting pen as set forth in claim 1 comprising a writing point assembly secured in said tubular holder by said fastening means.

7. A pen as set forth in claim 6, wherein said other terminal portion has an axially extending face spaced opposite an inner axially extending face of said holder, said axially extending face of the other terminal portion and the inner axial face of said holder defining therebetween said further portion of said air channel.

8. A pen as set forth in claim 7, wherein said holder and said other terminal portion have respective radially extending end walls defining therebetween yet another portion of said air channel communicating with said further portion.

9. An assembly as set forth in claim 1, wherein (a) the air channel on the fastening means of the outer axial face of said shell and also in the further substantial portion rotates the said shell and follows a helical rib of the fastening thread by only 180 degrees axially by-passing the bounding helical rib and further rotating by 180 degrees in its extension continuing these steps each time until it ends in a further portion of said air channel defining said axial face of the outer terminal portion and the inner axial face of said holder and wherein (b) the major diameter of the shell of the substantial portion of the air channel corresponds to the minor diameter of the fastening internal thread of the holder covering the total axial extension of the substantial portion.

10. An assembly as set forth in claim 1, wherein the other cup-shaped terminal portion of the shell defines radial non-capilar slots by-passing the radially extending end wall thereof and partly the side walls of the said other terminal portion and the air channel communicating with said ink storage space.

* * * * *